US006642849B1

(12) United States Patent
Kondziolka

(10) Patent No.: US 6,642,849 B1
(45) Date of Patent: Nov. 4, 2003

(54) HUSH DISABLE FEATURE FOR PHOTOELECTRIC SMOKE ALARM

(75) Inventor: Thomas Kondziolka, Chicago, IL (US)

(73) Assignee: Maple Chase Company, Downers Grove, IL (US)

( * ) Notice: Subject to any disclaimer, the term of this patent is extended or adjusted under 35 U.S.C. 154(b) by 139 days.

(21) Appl. No.: 10/014,686

(22) Filed: Dec. 11, 2001

(51) Int. Cl.[7] ..... G08B 23/00

(52) U.S. Cl. ..... 340/628; 340/629; 340/634; 340/636.15; 340/514; 340/515; 340/516; 340/517; 340/506; 340/521; 340/527

(58) Field of Search ..... 340/628, 629, 340/634, 636.15, 517, 506, 514, 515, 521, 527, 516

(56) References Cited

U.S. PATENT DOCUMENTS 4,595,914 A 6/1986 Siegel ..... 340/515
4,792,797 A 12/1988 Tanguay et al. ..... 340/628
5,093,651 A 3/1992 Thomas ..... 340/628
5,410,299 A 4/1995 Hard ..... 340/628
5,422,629 A 6/1995 Minnis ..... 340/630
5,568,129 A 10/1996 Sisselman et al. ..... 340/628
5,686,885 A 11/1997 Bergman ..... 340/514
5,705,979 A 1/1998 Fierro et al. ..... 340/517
5,777,550 A 7/1998 Maltby et al. ..... 340/514
5,815,066 A 9/1998 Pumilia ..... 340/309.15
5,905,438 A * 5/1999 Weiss et al. ..... 340/636.1

* cited by examiner

*Primary Examiner*—Daniel J. Wu
*Assistant Examiner*—Tai T. Nguyen
(74) *Attorney, Agent, or Firm*—Pearne & Gordon LLP

(57) ABSTRACT

A hush mode disabling device for a smoke alarm having a self-test function, a hush mode that engages upon activation of the self-test function to silence or desensitize the smoke alarm for a predetermined period of time, and a remote self-test controller. An improvement includes a hush mode disabler for determining whether the self-test function has presently been activated by the remote self-test controller and for disabling the hush mode if the self-test function has presently been activated by the remote self-test controller.

12 Claims, 3 Drawing Sheets

HUSH DISABLE FEATURE FOR PHOTOELECTRIC SMOKE ALARM

FIELD OF THE INVENTION

The present invention relates to a hush mode disabling circuit for a self contained smoke alarm that is connected to a remote fire alarm system.

BACKGROUND OF THE INVENTION

Smoke alarms often experience false alarms as a result of smoke produced from cooking, smoking and other non-threatening situations. Thus, it is desirable to be able to temporarily disable or desensitize a smoke alarm under such false-alarm conditions.

For this purpose, many modern smoke alarms include what is referred to as a silencing feature or hush mode. Typically, smoke alarms include a test button to allow a user to initiate a self-test function to assure the smoke alarm is working properly. In order to simplify smoke alarm construction and operation, many manufacturers have incorporated the hush mode into the test button. As such, when the test button is depressed, the smoke alarm will go into a silent or decreased sensitivity mode for a predetermined period of time, after which the smoke alarm will rearm itself in its normal operating mode.

FIG. 1 shows a typical photoelectric smoke alarm chip 100, Model No. A5358CA or A5366CA manufactured by Allegro Microsystems, Inc., connected to external circuitry with which it would normally be used. The entire circuit is contained within a smoke alarm enclosure 102. A power source 104 is provided to provide $V_{DD}$ and $V_{SS}$ (ground) for the circuit and the chip 100.

The enclosure 102 is provided with a smoke chamber 106 in which a infrared emitting diode 108 and an infrared photo diode 110 are contained. The emitting diode 108 is connected between pin 6 of the chip 100 and $V_{DD}$ of the circuit. The emitting diode 108 is driven by a oscillator and timing circuit 112 provided on the chip 100. The detecting diode 110 is connected between pin 3 of the chip 100 and $V_{DD}$ of the circuit. The output of the detecting diode 110 is amplified by a photoelectric amplifier 114 provided on the chip 100. The output of the photo amp 114 is fed to a logic circuit 116 provided to the chip 100.

When smoke particles enter the smoke chamber 106, the particles cause the light emitted by the emitting diode 108 to be diffracted before it is received by the detecting diode 110. The logic circuit 116 of the chip 100 detects this diffraction and, when appropriate, causes a horn driver 118 provided on the chip 100 to drive an external horn 120 which generates and audible alarm.

A momentary push button 122 connected between $V_{DD}$ and pin 16 of the chip 100, when pressed, causes the chip 100 to test the smoke alarm circuit and drive the horn 120 if the circuit is functioning properly.

To avoid false alarms, a hush mode is provided to the chip 100. To utilize the hush mode, a voltage divider VD comprising two resistors R1, R2 is connected between the power source 104 and pin 4 of the chip 100. A ratio of the voltage provided by the voltage divider VD and $V_{DD}$ sets a decreased sensitivity level of the smoke alarm circuit when hush mode is active. Whenever the push-button 122 is pressed, hush mode is activated for a predetermined period of time. To disable the hush mode entirely, the voltage VD provided to pin 15 of the chip 100 must be set to $V_{SS}$. In this way, the hush mode is either permanently enabled or permanently disabled, depending upon the circuit configuration.

In recent years, there has been a need to provide inexpensive centralized fire alarm systems. In order to do this, many manufacturers have taken inexpensive individual smoke alarms and linked them together to form a centralized system. One of the features of these systems is the ability to perform a self-test of all of the smoke alarms in the system simultaneously from a centralized or remote location.

However, when smoke alarms having the hush mode described above enabled are used in such a network system, the activation of a remote self-test will engage the hush mode. As a result, all of the smoke alarms will be silenced or have reduced sensitivity for a period of time. During this time period, the areas protected by the smoke alarms will be at an increased risk of an undetected fire hazard. Further, the occupants of the individual areas may not be aware of the reduced sensitivity of the smoke alarm. Thus, it would be desirable to provide a means for selectively disabling and enabling the hush mode of this type of smoke alarm.

BRIEF SUMMARY OF THE INVENTION

To overcome the disadvantages of the prior described above, the present invention provides a circuit for disabling the hush mode of a smoke alarm during a remote test. According to an aspect of the present invention, a hush mode disabling device for a smoke alarm having a self-test function, a hush mode that engages upon activation of the self-test function to silence or desensitize the smoke alarm for a predetermined period of time, and a remote self-test controller is provided. An improvement comprises a hush mode disabler for determining whether the self-test function has presently been activated by the remote self-test controller and for disabling the hush mode only if the self-test function has presently been activated by the remote self-test controller.

DETAILED DESCRIPTION OF THE INVENTION

As mentioned above and shown in FIG. 1, smoke alarm circuits contained within a single integrated circuit package are readily available from a variety of manufacturers.

Figure 2:
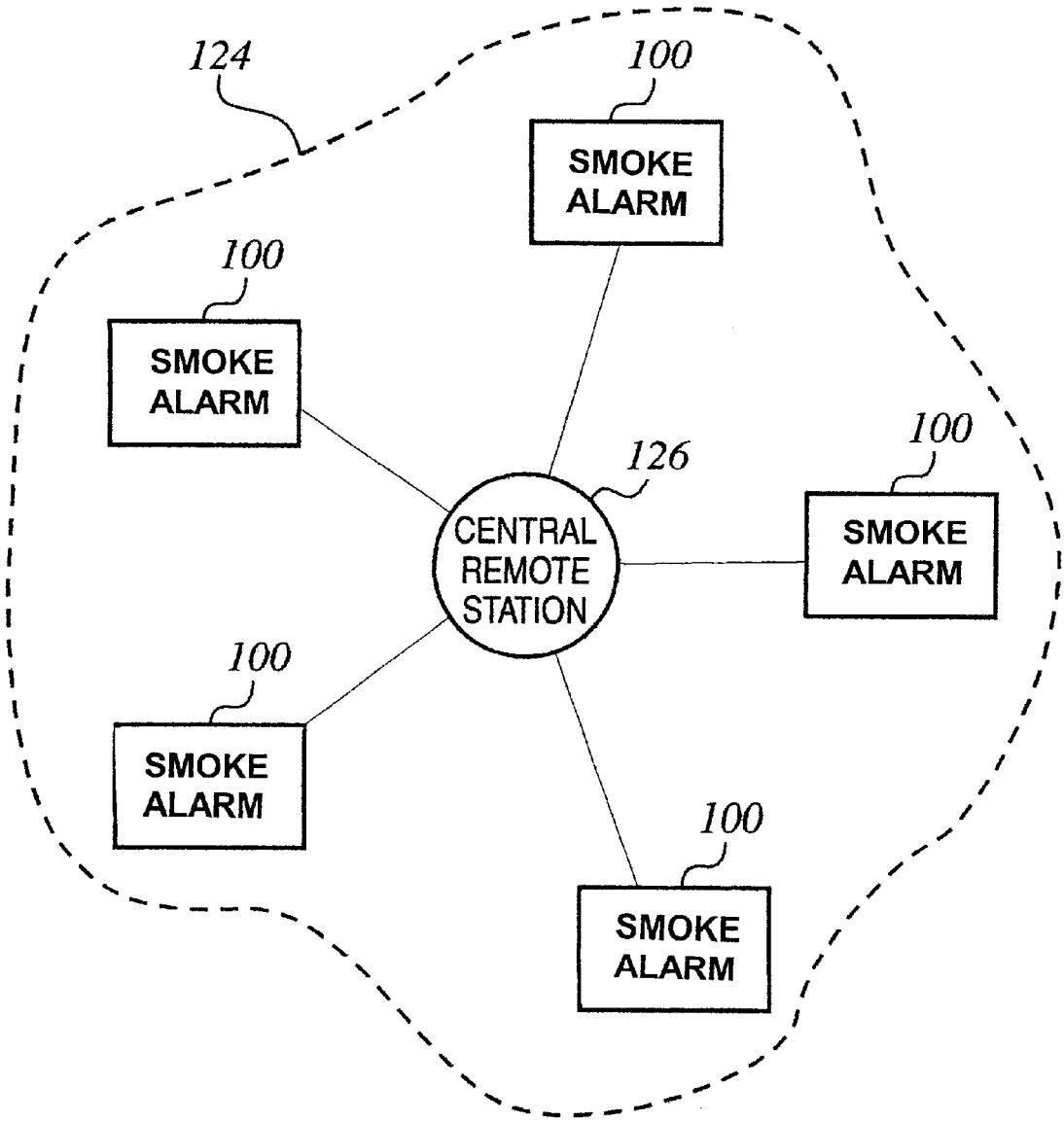
FIG. 2 is a schematic view of a network of integrated circuit smoke alarm.

These integrated circuit smoke alarms, such as the Allegro A5358CA or A5366CA, are designed to be self sufficient. As shown in FIG. 2, however, due to their increasing economy, multiple integrated circuit smoke alarms 100 are sometimes networked together to form a economical multiple-point fire alarm system 124. When used in such a configuration, the individual integrated circuit smoke alarms 100 are connected to a central remote station 126 where they can be monitored simultaneously and their self-test functions activated remotely.

Thus, when a smoke alarm is used in such a networked configuration and connected to a remote self test activation means, it would be useful to be able to selectively enable the hush mode. When a self test is activated remotely, it is desirable to not activate the hush mode of the smoke alarm so that the smoke alarm is not desensitized without local occupants being aware. However, it is also desirable for the hush mode to be available for local activation by pressing the test button, for situations such as false alarms when the hush mode would normally be used.

The present invention provides a remote hush disabling means for disabling the hush mode when the self-test is initiated be the remote station 126.

Figure 3:
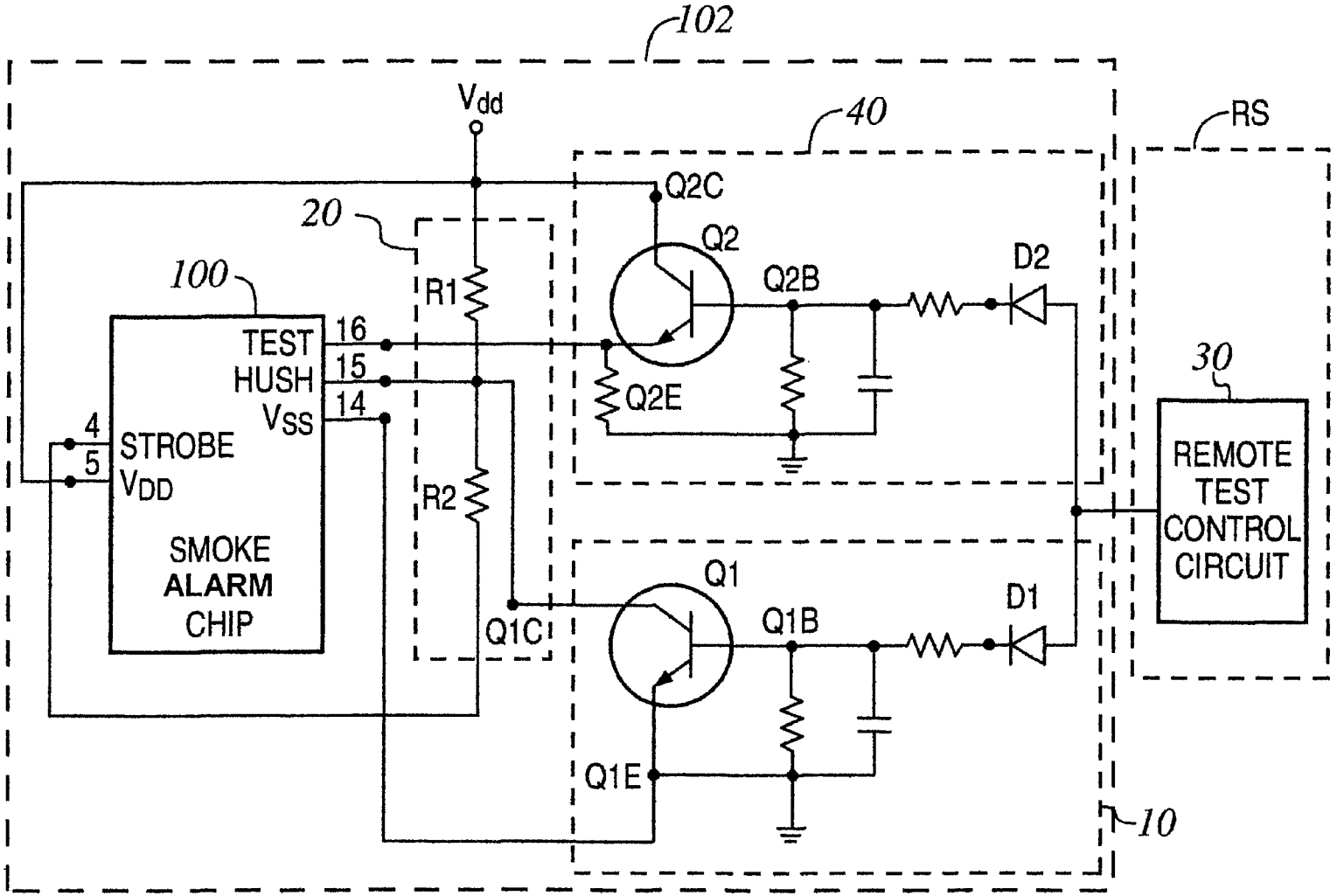
FIG. 3 is a schematic view of a hush mode disable circuit according to the present invention.

As an embodiment of the present invention, FIG. 3 shows a hush mode disable circuit 10 designed to work with the Allegro A5358CA or A5366CA photoelectric smoke alarm integrated circuit 100, that is connected in a network configuration as shown in FIG. 2. The chip 100 and the hush mode disable circuit 10 are contained within the smoke alarm enclosure 102. The remote station 126 is external to and remote from this enclosure 102.

In order to function, the chip 100 requires additional circuitry which is well known in the prior art. One example of such circuitry is shown in FIG. 1.

Figure 1:
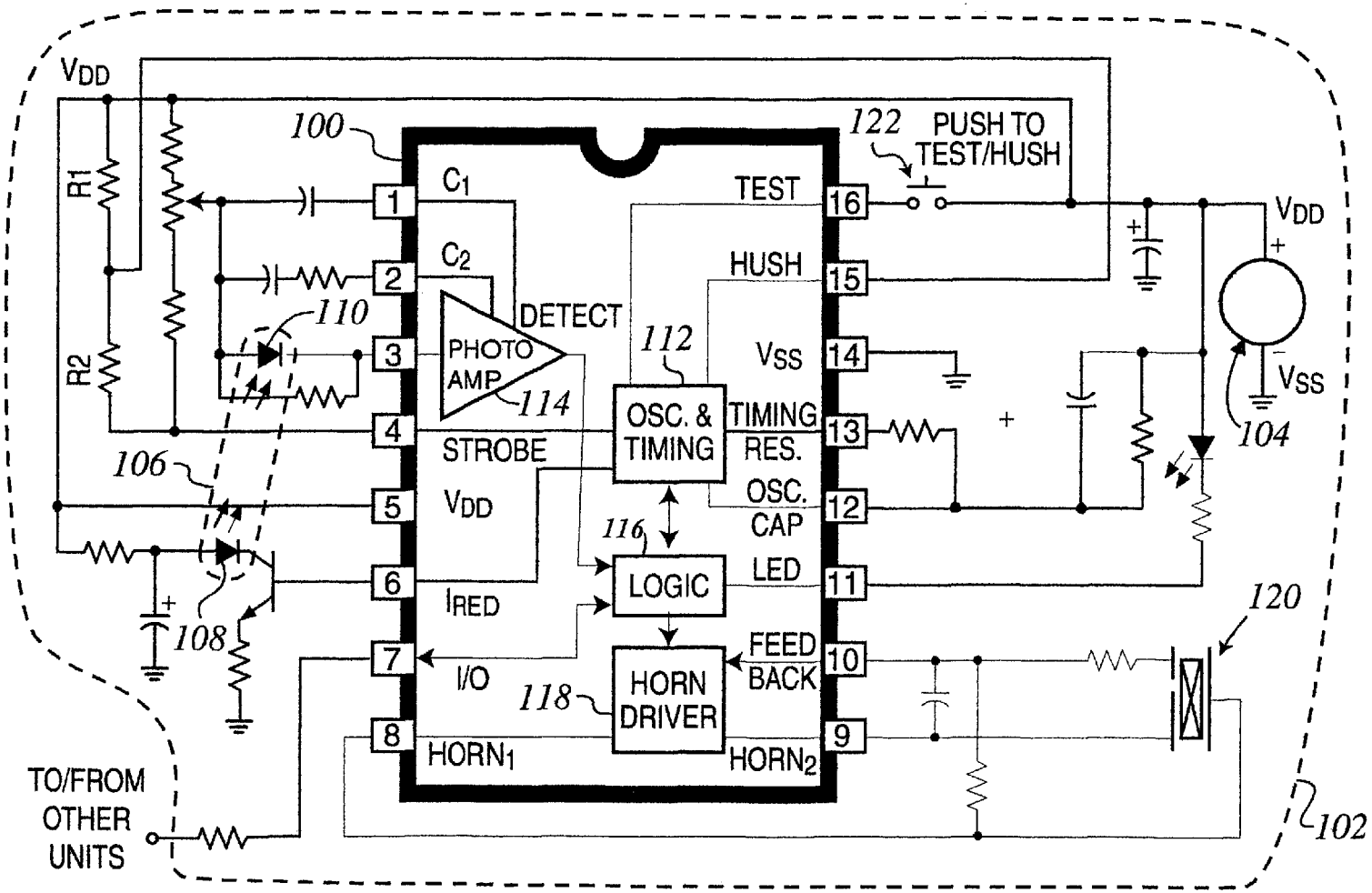
PRIOR ART FIG. 1
FIG. 1 is a schematic view of a prior art integrated circuit smoke alarm chip and a typical circuit with which it may be used.

In operation, the chip 100 goes into a decreased sensitivity or hush mode for a period of ten minutes after a test button 122, shown in FIG. 1, connected to self-test input pin 16 of the chip 100 is pressed, thereby shorting pin 16 to $V_{DD}$, which is normally 9 VDC. The level of reduced sensitivity during hush mode is set externally to the chip 100 by connecting a hush mode sensitivity level configuration input pin 15 to the junction of a voltage divider network 20 of two resistors (R1, R2) connected between $V_{DD}$ and pin 4 of the chip 100. When pin 15 of the chip 100 is connected directly to ground, the hush mode is set to function at the full sensitivity of the chip 100, and thus the hush mode is effectively disabled.

In order to disable the hush mode of the chip 100 only during a remote activation of the test function, the hush mode disable circuit 10 is provided with a transistor Q1 (FIG. 3). The base Q1B of the transistor Q1 is connected through a diode D1 to a remote test control circuit 30 contained within the remote station 126. The collector Q1C is connected to pin 15 of the chip 100 and the emitter Q1E is connected to ground.

In order to remotely activate the test function of the chip 100, a remote test function driver circuit 40 is provided. The driver circuit 40 comprises a transistor Q2. The base Q2B is connected to the remote test control circuit 30 through a diode D2. The collector Q2C is connected to $V_{DD}$ and the emitter Q2E is connected to pin 16 of the chip 100.

When the remote circuit 30 causes voltage at the cathode of the diode Dl of the hush mode disable circuit 10 to go from approximately 0 VDC to 9 VDC, the transistor Q1 turns on and causes pin 15 of the chip 100 to be effectively shorted to ground, thereby disabling the hush mode. At the same time, the remote circuit 30 causes voltage at the cathode of the diode D2 of the remote test function driver circuit 40 to go to approximately 9 VDC, turning the transistor Q1 on, which causes pin 16 of the chip 100 to be effectively shorted to $V_{DD}$, thereby activating the test function.

When the push-button 122 is pressed, pin 16 of the chip 100 is shorted to $V_{DD}$, and the self test is activated without disabling the hush mode. In this way, the test function can be locally activated and the hush mode enabled for a period of ten minutes each time the push button is pressed.

As alternatives to the circuit 10 described above, the hush disabler of the present invention could comprise means such as an integrated circuit, one or more mechanical relays, diode logic gates, a silicon-controlled rectifier (SCR), an additional connection from the remote test control circuit 30, or any other means that would be appreciated by one of ordinary skill in the art as sufficient to perform the described object of the present invention. Although particular embodiments of the invention have been described in detail, it is understood that the invention is not limited correspondingly in scope, but includes all changes and modifications coming within the spirit and terms of the claims appended hereto.

What is claimed is:

1. A hush mode disabling device for a smoke alarm having a self-test function, a hush mode that engages upon activation of the self-test function to silence or desensitize the smoke alarm for a predetermined period of time, and a remote self-test controller, wherein an improvement comprises:

a hush mode disabler for determining whether the self-test function has presently been activated by the remote self-test controller and for disabling the hush mode if the self-test function has presently been activated by the remote self-test controller.

2. The hush mode disabling device of claim 1, wherein the hush mode disabler comprises a semiconductor transistor.

3. The hush mode disabling device of claim 2, wherein the semiconductor transistor is an NPN-type transistor.

4. The hush mode disabling device of claim 2, wherein the semiconductor transistor comprises:

a collector connected to a hush mode sensitivity level configuration input provided on the smoke alarm;

an emitter connected to a fixed voltage level; and a base connected to the remote self-test controller wherein, when the remote self-test controller energizes the base of the transistor, the fixed voltage level is seen on the hush mode sensitivity level configuration input, causing the hush mode to be substantially disabled.

5. The hush mode disabling device of claim 4, wherein the fixed voltage level is set at circuit ground.

6. A self-contained smoke alarm connected to a centralized fire alarm system, comprising:

a self-test function;

a self-test button for activating the self-test function;

a hush mode, whereby the self-contained smoke alarm is desensitized for a predetermined period of time after the self-test function is activated;

a remote self-test controller, whereby the self-test function of the self-contained smoke alarm can be activated through the centralized fire alarm system from a location remote to the self-contained smoke alarm; and a remote hush disabling means for disabling the hush mode when the self-test function is activated by the remote self-test controller.

7. The self-contained smoke alarm of claim 6, wherein the hush mode disabling means comprises a semiconductor transistor.

8. The self-contained smoke alarm of claim 7, wherein the semiconductor transistor is an NPN-type transistor.

9. The self-contained smoke alarm of claim 7, wherein the semiconductor transistor comprises:

a collector connected to a hush mode sensitivity level configuration input provided on the self-contained smoke alarm;

an emitter connected to a fixed voltage level; and a base connected to the remote self-test controller wherein, when the remote self-test controller energizes the base of the transistor, the fixed voltage level is seen on the hush mode sensitivity level configuration input, causing the hush mode to be substantially disabled.

10. The hush mode disabling device of claim 9, wherein the fixed voltage level is set at circuit ground.

11. A hush mode disabling circuit for a smoke alarm having a hush mode connected to a remote self-test controller, the disabling circuit comprising:

a collector connected to a hush mode sensitivity level configuration input provided on the smoke alarm;

an emitter connected to a fixed voltage level; and a base connected to the remote self-test controller wherein, when the remote self-test controller energizes the base of the transistor, the fixed voltage level is seen on the hush mode sensitivity level configuration input, causing the hush mode to be substantially disabled.

12. A smoke alarm with a hush mode comprising:

a smoke alarm;

a smoke alarm self-test means for performing a self-test of the operation of the smoke alarm;

a remote self-test controlling means for activating the self-test means from a remote location;

a hush means for disabling or desensitizing the smoke detection means for a predetermined period of time after the self-test means has been activated; and a hush disabling means for deactivating the hush means when the self-test means has been activated by the remote self-test activation means.

* * * * *